US005865382A

United States Patent [19]

Bielagus

[11] Patent Number: 5,865,382

[45] Date of Patent: Feb. 2, 1999

[54] PROTECTION SYSTEM FOR A WOOD CHIP DESTRUCTURING DEVICE

[75] Inventor: Joseph B. Bielagus, Tualatin, Oreg.

[73] Assignee: Beloit Technologies, Inc., Wilmington, Del.

[21] Appl. No.: 788,144

[22] Filed: Jan. 24, 1997

[51] Int. Cl.[6] ..... B02C 25/00

[52] U.S. Cl. ..... 241/28; 241/37; 241/235

[58] Field of Search ..... 241/37, 30, 28, 241/235; 100/176

[56] References Cited

U.S. PATENT DOCUMENTS

| | | | |
|---|---|---|---|
| 2,905,396 | 9/1959 | Fye | 241/37 |
| 3,406,624 | 10/1968 | Kutchera et al. . | |
| 3,604,645 | 9/1971 | Keyes | 241/37 |
| 4,295,614 | 10/1981 | Bond | 241/37 |
| 4,619,408 | 10/1986 | Sangati | 241/37 |
| 4,723,718 | 2/1988 | LaPointe . | |
| 4,953,795 | 9/1990 | Bielagus | 241/235 |
| 5,263,651 | 11/1993 | Nadarajah | 241/28 |

*Primary Examiner*—Mark Rosenbaum
*Attorney, Agent, or Firm*—Dirk J. Veneman; Raymond W. Campbell; Paul F. Donovan

[57] ABSTRACT

An apparatus and method for protecting a wood chip destructuring device from damage due to tramp material. The destructuring device includes a pair of destructuring rolls operating a pre-established distance from each other and an infeed chute for delivering a stream of wood chips to pass through a region between the destructuring rolls. Said protection system includes a sensing unit and a control unit to detect tramp material present in the chip stream. If tramp material is detected in the wood chip flow, the protection system operates to further separate the destructuring rolls so that the surfaces of the destructuring rolls will not be damaged by the tramp material as the flow of material passes between the destructuring rolls.

6 Claims, 1 Drawing Sheet

PROTECTION SYSTEM FOR A WOOD CHIP DESTRUCTURING DEVICE

BACKGROUND OF THE INVENTION

1. Field of the Invention

The present invention relates to a destructuring apparatus in which wood chips are passed between closely operating rolls with compressive forces being exerted on the chips by the rolls, and relates more particularly to protecting the working surfaces of the closely operating rolls through the use of an apparatus to detect the existence of tramp material contained within the flow of wood chips, such that when tramp material is detected the closely operating rolls adjust to allow the flow of wood chips and tramp material to pass.

2. Description of the Prior Art

In a typical papermaking process, logs are debarked and chipped and the wood chips are treated to release individual cellulose fibers for the preparation of paper making stock.

One device for treating the chips to enhance liquor penetration and subsequent pulping operations is a wood chip cracking apparatus disclosed in U.S. Pat. No. 4,953,795, wherein chips are passed between closely operating rolls with compressive forces being exerted on the chips by the rolls. Another form of chip processing device is a chip slicer which includes a rotor operating within a drum, wherein oversized chips are forced against knives and sliced to acceptable thickness.

Common to chip processing devices is a conduit for handling the chips being led to the chip processing device and for controlling a uniform supply of wood chips to the chip processing device. Also common to all chip processing devices is the risk that tramp material, e.g., metal, stones, dirt, debris, etc., is contained within the chip flow stream, and such tramp material has a devastating effect on the chip processing apparatus, breaking knives or damaging operating surfaces to the extent that the machine must immediately be shut down, and the resultant damage repaired and/or equipment replaced.

A device for preventing damage to destructuring apparatuses due to the presence of tramp material is disclosed in U.S. Pat. No. 5,263,651, wherein an apparatus is provided capable of handling a continual flow of wood chips to a chip processing machine and automatically bypassing or shunting tramp material without interrupting the continuous machine operation and automatically restoring normal wood chip stream flow to the mechanism after a limited predetermined time.

One objective of the apparatus disclosed in U.S. Pat. No. 5,263,651 is to provide a method or apparatus for treating wood chips which prevents damage to treating and destructuring apparatus due to the presence of tramp material. The invention disclosed in U.S. Pat. No. 5,263,651 operates in such a manner that when tramp material is detected, the chip flow is diverted from the chip processing apparatus. Good chips flow to the chip processing apparatus and chips with tramp material flow to a dumping bin. In this way, the flow of chips to the chip processing apparatus is interrupted when tramp material is detected, thus preventing damage to the destructuring apparatus due to the presence of tramp material. Essentially, the safety device of U.S. Pat. No. 5,263,651 operates as a separator. Importantly, because the safety device diverts the flow of chips when tramp material is detected, the fiber contained in the wood chips that are diverted from the processing equipment is lost.

SUMMARY OF THE INVENTION

The problem of fiber loss connected with the prior safety apparatus has been obviated by this invention. A tramp material detecting device is located in front of a chip processing device, such as two closely operating destructuring rolls. Chips are fed to the destructuring rolls via an infeed chute, but before reaching the destructuring rolls, the wood chips pass the present tramp detecting device. When tramp material is sensed, a signal is sent to a hydraulic system which is interconnected with at least one of the destructuring rolls, such that at least one of the rolls is moved away from the other roll, thereby allowing the material to pass between the rolls without being crushed. After the tramp material mix has passed the rolls, the rolls return to their original operating positions. The rolls are separated for a minimal amount of time.

Accordingly, it is a feature of this invention to provide a sensor device to detect the existence of tramp material, whereupon the spacing between the closely operating rolls is adjusted to allow the tramp material mix to pass. In this way, the surfaces of the destructuring rolls are protected, in that they are not in close communication when tramp material, such as metal, passes between the closely operating rolls.

Another feature of this invention is to provide a method to protect the surfaces of closely operating destructuring rolls.

A further feature of this invention is the continual feeding of chips to chip processing apparatus, such that no fiber contained within the wood chips is lost.

These, and other objects, features and advantages of the invention will become readily apparent to those skilled in the art upon reading the description of the preferred embodiment, in conjunction with the attached drawing.

DESCRIPTION OF THE PREFERRED EMBODIMENTS

Figure 1:
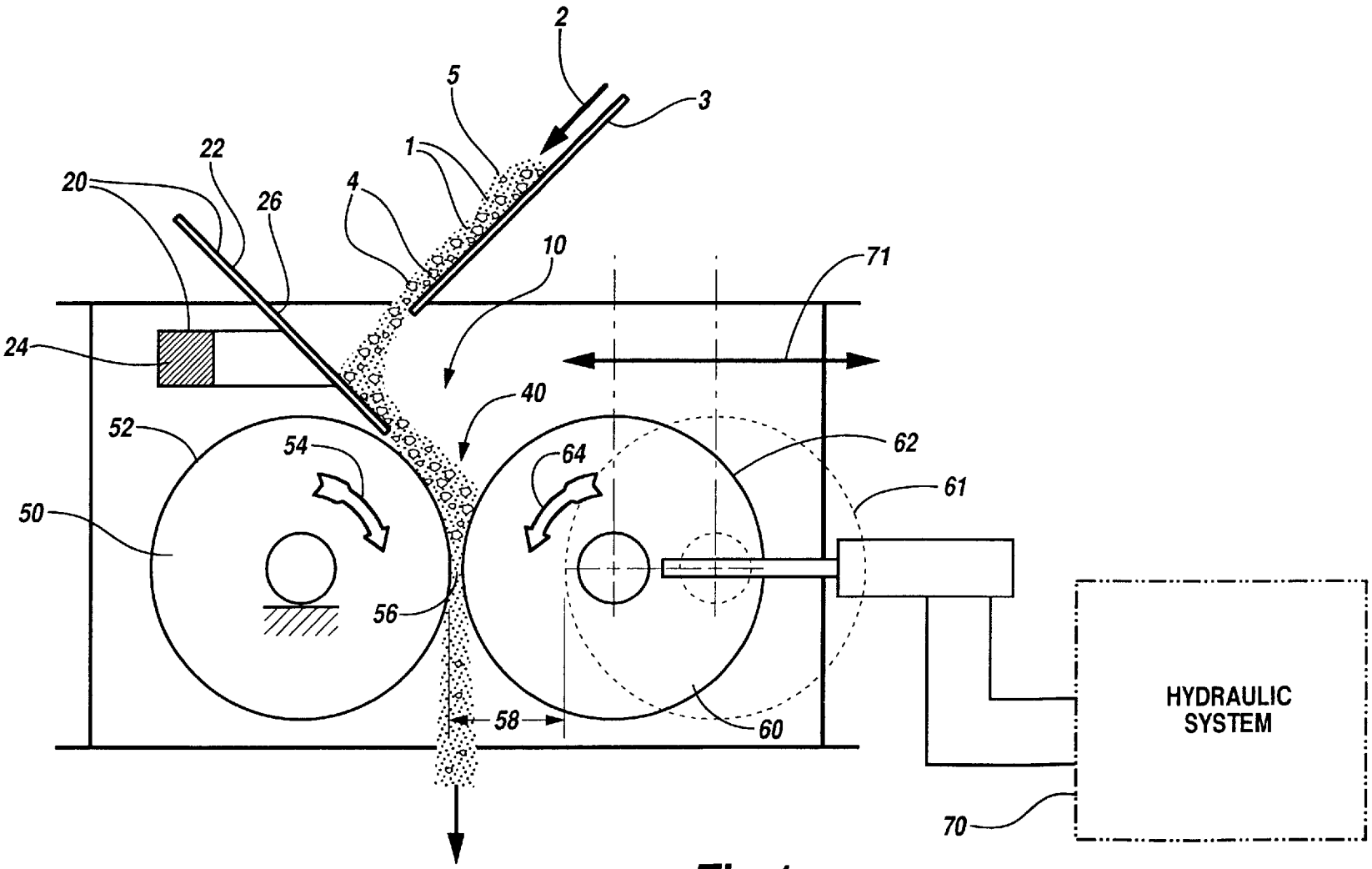
FIG. 1 is an elevational view, shown in schematic form of an infeed chute feeding a chip flow stream to a tramp detecting device in which the chip flow then proceeds to a chip processing apparatus, all of which are constructed and operated in accordance with the principles of the present invention.

As shown in FIG. 1, a flow of wood chips (5) indicated by the arrowed line (2) is carried by an infeed chute (3) to wood chip processing equipment shown generally at (10) having a detection device (20) embodying the present invention. The wood chip flow (5) includes wood chips (1) and tramp material (4).

The infeed chute (3) is located above the wood chip processing equipment (10) such that the wood chips (1) flow downwardly to the chip processing equipment (10). The detection device (20) is positioned downstream from the infeed chute (3) and upstream of the wood chip processing equipment (10). The detection device (20) includes a chip flow sensing unit (22) and a control unit (24). The sensing unit (22) includes an impingement surface (26) for receiving the entire chip flow (5) and sensing characteristics of the impingement of flow components on the impingement surface. The sensing unit (22) may take various forms, such as a sound detecting device which senses the presence of tramp material (4) when the tramp material (4) impacts the sound detecting device or an accelerometer which senses vibration (i.e., frequency levels) rather than sound induced by impingement of chip flow (5) components on the device. The control unit (24) is operationally connected to the sensing unit (22) to receive and analyze signals from the sensing unit (22) and send signals to the wood chip processing equipment (10) based on characteristics of the chip flow (5) determined by the control unit (24) from signals received from the sensing unit (22).

When the wood chip flow (5) impacts the sensing unit (22), the tramp material (4) produces a different sound and frequency than the wood chips (1). If a sound detecting device such as a microphone (not shown) is used, the sound detecting device sends a signal to the control unit (24) which determines if the wood chip flow (5) contains any tramp material (4) based on the differences in sound created by wood chips (1) and tramp material (4). Because of the noisy environment that wood chip processing equipment (10) operates in, the sound detection device (22) should be enclosed within an isolated chamber (not shown) so that the sound detection device will only detect the sounds created by the wood chips (1) and tramp material (4) of the wood chip flow (5), when these materials impact the sound sensing unit. If an accelerometer is used, the accelerometer sends a signal to the control unit (24) which determines if the wood chip flow (5) contains any tramp material (4) based on differences in vibration frequency created by the presence of tramp material (4).

The aforementioned wood chip processing equipment (10) may take the form of many different apparatuses. As illustrated in FIG. 1, the wood chip processing equipment (10) is shown as a wood chip destructuring device (40), the destructuring device including a pair of destructuring rolls operating at a pre-established distance from each other. A first destructuring roll (50) is rotatably mounted to a bearing housing (not shown). A second destructuring roll (60) located a pre-established distance from said first destructuring roll (50) and is connected to a second bearing house member (not shown). The second destructuring roll (60) and the second destructuring roll's bearing housing member are connected to a hydraulic system (70), which controls the positioning of the second roll (60) relative to the first roll (50) in a manner well-known to those skilled in the art. The hydraulic system (70) is able to move the second roll (60) closer or farther away from the first roll (50), as indicated by arrowed line (71).

The detection device (20) located upstream of the destructuring device (40) is positioned above the first destructuring roll (50) such that wood chips (1) falling off of the sensing unit (22) fall onto the outside surface (52) of the first destructuring roll (50), or directly between rolls (50) and (60). As the first destructuring roll (50) rotates in a clockwise direction indicated by arrow (54), the wood chips (1) fall through the gap (56) created by the pre-established distance between the two destructuring rolls (50, 60). As the wood chips (1) fall through the gap (56), since the second destructuring roll (60) rotates in a counterclockwise direction shown by arrow (64), the chips (1) will be cracked or reshaped by the two destructuring rolls (50, 60) as described in the aforementioned U.S. Pat. No. 4,953,795.

In operation, a wood chip flow (5) is fed to destructuring rolls (50, 60) after which the processed wood chips proceed to further papermaking apparatuses (not shown). The wood chips (1) travel from the infeed chute (3) to the detection device (20), such that when the chip flow (5) impacts the sensing unit (22), a signal is sent to the control unit (24) of the detection device (20), to determine if any tramp material (4) is contained within the wood chip flow (5). If tramp material (4) is detected in the wood chip flow (5), the control unit (24) sends a signal to the hydraulic system (70). When the hydraulic system (70) receives the signal from the control mechanism (24) of the detection device (20), indicating the tramp material is present in the wood chip flow (5), the hydraulic system (70) operates in a manner such that it retracts the second destructuring roll (60), the retracted position being shown schematically by the broken outline (61) of roll (60). A larger gap (58) than the gap (56) existing between the rolls in the operating position is created when the second destructuring roll (60) is retracted from the first destructuring roll (50). As the second destructuring roll (60) is retracted, the wood chip flow (5) containing the tramp material (4) passes through the gap (58) created by the destructuring rolls (50, 60). Because the second destructuring roll (60) is retracted from the first destructuring roll (50), the wood chip flow (5) is not compressed between the destructuring rolls (50, 60) in a significant manner such that the tramp material (4) contained within the wood chip flow (5) could damage the surfaces (52, 62) of the destructuring rolls (50, 60). Once the tramp material (4) has passed the destructuring rolls (50, 60), determined by a set amount of time through the use of a timer mechanism which may be incorporated in the control unit (24), the hydraulic system (70), or repositioning means, operates to position the second destructuring roll (60) back to its operating position. In this manner, the closely operating destructuring rolls (50, 60) are once again compressing the wood chip flow (5) as it passes between the two destructuring rolls (50, 60). Accordingly, the surfaces (52, 62) of the destructuring rolls (50, 60) are protected from being damaged by tramp material (4) contained within the wood chip flow (5).

While an apparatus and method for protecting the surfaces of a chip destructuring device has been shown and described in detail, herein, various changes may be made without departing from the scope of the present invention.

We claim:

1. A protection system for protecting a wood chip destructuring device from damage due to tramp material, said protection system comprising:

a pair of destructuring rolls operating a pre-established distance from each other;

an infeed chute for delivering a stream of wood chips to pass through a region between said destructuring rolls;

a detection device positioned downstream from said infeed chute to detect tramp material present in the chip stream;

destructuring roll separating means for increasing the distance between said destructuring rolls in response to said detection device detecting tramp material in the chip stream; and repositioning means for returning said destructuring rolls to the pre-established distance after the tramp material has passed through the region between said rolls.

2. A protection system as defined in claim 1, in which only one roll of the pair of destructuring rolls is adapted for movement by said separating means and by said repositioning means.

3. A protection system as defined in claim 1, wherein said detection device intercepts the chip stream and said detection device has an impingement surface such that said impingement surface receives the chip stream.

4. A protection system as defined in claim 3, wherein said detection device includes a sound detecting device and a control unit capable of discriminating between the sound caused by wood chips impacting the impingement surface and the sound caused by tramp material impacting the impingement surface.

5. A protection system as defined in claim 3, wherein said detection device includes an accelerometer responsive to changes in vibration with the passage of tramp material in the chip stream.

6. A method for protecting a wood chip destructuring device from damage due to tramp material, the destructuring device including a pair of destructuring rolls operating a pre-established distance from each other and an infeed chute for delivering a stream of wood chips to pass through a region between the destructuring rolls, said method comprising the following steps:

supplying a flow of wood chips to said region between said destructuring rolls;

detecting the presence of tramp material in the supply of wood chips upstream of said destructuring rolls;

increasing the distance between said destructuring rolls when tramp material is sensed within the supply of wood chips; and repositioning said destructuring rolls to said pre-established distance between said destructuring rolls after the tramp material has passed through the region between the destructuring rolls.

* * * * *